United States Patent [19]

Nehrig

[11] 4,077,608

[45] Mar. 7, 1978

[54] HYDRAULIC HAND JACK

[75] Inventor: R. Harlan Nehrig, Stevensville, Mich.

[73] Assignee: Auto Specialties Manufacturing Company, St. Joseph, Mich.

[21] Appl. No.: 756,893

[22] Filed: Jan. 5, 1977

[51] Int. Cl.[2] ..... B66F 3/24

[52] U.S. Cl. ..... 254/93 H; 91/402

[58] Field of Search ..... 254/93 H, 93 R; 91/401, 91/402

[56] References Cited

U.S. PATENT DOCUMENTS

| | | | |
|---|---|---|---|
| 2,456,105 | 12/1948 | Berg | 254/93 H |
| 3,685,797 | 8/1972 | Orr | 254/93 R |
| 3,818,805 | 6/1974 | Johansson | 91/402 |
| 3,925,985 | 12/1975 | Peterson | 91/402 |

FOREIGN PATENT DOCUMENTS

| | | | |
|---|---|---|---|
| 1,954,936 | 5/1971 | Germany | 91/402 |

*Primary Examiner*—Robert C. Watson
*Attorney, Agent, or Firm*—Olson, Trexler, Wolters, Bushnell & Fosse, Ltd.

[57] ABSTRACT

A hydraulic jack is disclosed, of the type comprising a ram having a head portion reciprocable in a cylinder between two cylinder ends, and sealing means carried on the ram head portion to provide a substantially fluid-tight seal between the ram and the cylinder interior surface. In this jack, an open sided pressure relief trough is formed in the interior surface of the cylinder adjacent one end to permit the flow of fluid past the sealing means when the head portion is located substantially adjacent the cylinder end and relief trough. Fluid bleeding action past the relief trough thus prevents forcing the ram head and sealing means against the cylinder end. When the jack is so constructed, the sealing means can include an elastomeric seal cup member which will not be damaged by its travel past the trough.

13 Claims, 3 Drawing Figures

HYDRAULIC HAND JACK

BACKGROUND OF THE INVENTION

This invention relates generally to hydraulic jacks and the like, and more particularly concerns apparatus for halting jack extension at a predetermined location and for preventing the creation of excessive pressure and forces within the jack.

Hydraulic jacks such as those disclosed and claimed in U.S. Pat. Nos. 2,464,254; 2,453,482 and 2,548,903 have met with great commercial success in markets requiring jacks for lifting heavy loads such as truck vehicles and the like. They are compact and safe, yet permit the user to apply relatively great lifting force without excessive effort.

These jacks commonly include a hydraulic cylinder in which is reciprocally mounted a ram. The ram can be hydraulicly extended from the cylinder to provide the desired lifting action. This extension action is provided by pumping hydraulic fluid into a chamber defined inside the cylinder by the cylinder walls, a closed cylinder end, and an opposed ram end.

The introduction of excessive amounts of fluid into this lifting chamber could cause excessive pressure build up within the jack, and consequent damage to the jack by jamming the ram piston end against the cylinder top end. To prevent this, relief ports permit fluid to be bled from the cylinder as the ram piston end reaches a designed maximum extension of its travel. A radially extending relief port is disclosed in U.S. Pat. No. 2,835,541, and another maximum extension relief device is disclosed in U.S. Pat. No. 2,520,426.

To provide the proper seal between the ram piston end and the hydraulic cylinder interior surface, packing devices are provided. Usually this packing includes a sealing gasket or cup member. U.S. Pat. Nos. 2,453,482; 2,520,426; 2,548,902; and 2,548,903 remark upon packing cups formed of leather or other flexible material. But commercial practice has practically dictated the manufacture of such cups from leather. While expensive, this leather material has been able to withstand the high pressures generated within the jack during a long service life, and has exhibited relatively great resistance to damage by cutting or scoring when the cup is moved past a relief hole or port bored or otherwise extended radially through the cylinder wall.

It is the general object of the present invention to provide a pressure relief mechanism for a hydraulic jack of the type described which will inhibit cutting or scoring action directed against the packing cup and consequently will permit the widespread use of packing cups formed of elastomeric material.

It is yet another object of the invention to provide such a relief port which can be offered in the finished jack at a relatively low cost, yet which will prove fully reliable in operation.

Other objects and advantages of the invention will become apparent upon reading the following detailed description and upon reference to the drawings. Throughout the drawings, like reference numerals refer to like parts.

DETAILED DESCRIPTION

While the invention will be described in connection with a preferred embodiment, it will be understood that it is not intended to limit the invention to this embodiment. On the contrary, it is intended to cover all alternatives, modifications and equivalents as may be included within the spirit and scope of the invention as defined by the appended claims.

Figure 1:
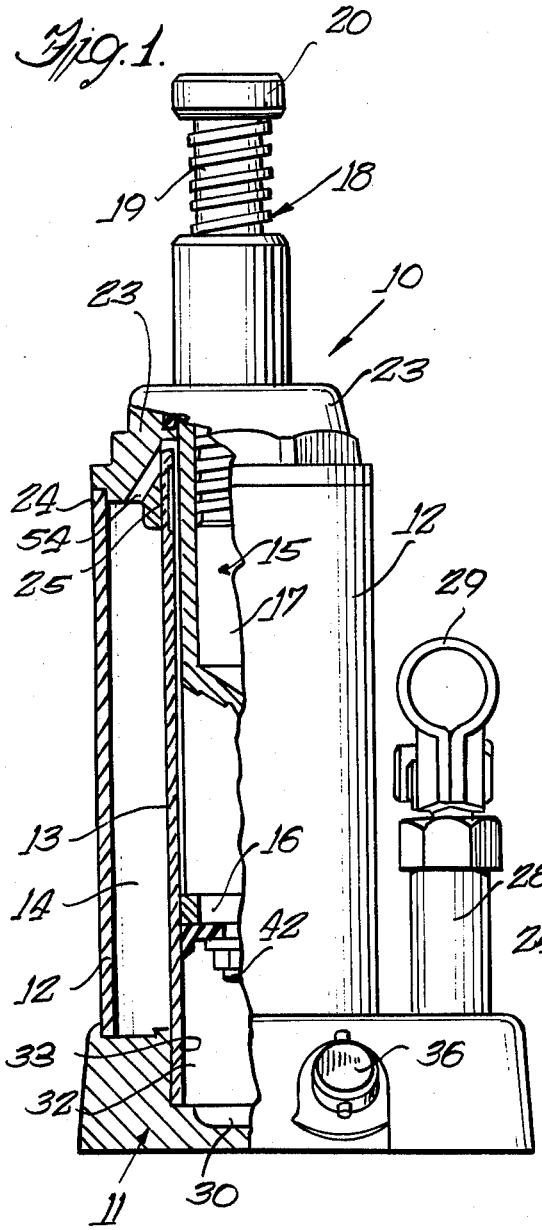
FIG. 1 is an elevational view of a jack showing, in partial section, portions of the jack interior and the novel pressure relief device.

Turning first to FIG. 1, there is shown a hydraulic jack 10 which includes an embodiment of the novel pressure relief device. In general, this jack includes a base 11 to which is affixed an outer cylindrical sleeve 12. Carried concentrically within the sleeve 12 is a hydraulic cylinder 13; between the sleeve 12 and cylinder 13 there is thus created an annular hydraulic fluid reservoir 14. Mounted for reciprocation within the cylinder 13 is a hydraulic ram 15 which can be considered to comprise a head portion 16, a rod portion 17, and a foot 18. Here, this foot 18 includes an extension member 19 threaded into the ram foot 18 and rod 17. By appropriately turning the extension member 19, the range of jack operational travel can be adjusted. This extension member 19 terminates in a pad member 20 which is shaped for engaging various loads. The ram rod portion 17 slides through a cap 23 affixed to a top 24 of the sleeve 12 and a top 25 of the cylinder 13.

In operation, a hydraulic pump 28 is operated by appropriately manipulating a handle socket member 29. This pump 28 draws hydraulic fluid from the reservoir 14 and introduces it into a base well 30 through a passage (not shown) of given cross-sectional size also formed in the jack base 11. Continued pump operation introduces progressively greater amounts of fluid into the well 30 and a chamber 32 defined by the ram head end 16, the base 11, and an interior surface 33 of the cylinder 13. Still further introduction of fluid into the chamber 32 forces the ram head end 16 progressively toward the cylinder top end 25. When load lowering and/or jack retraction is desired, a valve 36 is opened to permit hydraulic fluid to flow from the chamber 32 back into the fluid reservoir 14.

To provide a substantially fluid-tight seal between the cylinder interior surface 33 and the ram head end 16, packing structure 40 is mounted, as by an appropriate nut and bolt 41, on the ram head end 16. Here this packing structure 40 takes the form of a support and retainer ring 43 and an inverted cup member 44 which includes at its radially outward edges 45 elongated wiper surfaces 46.

Within the cap 23, an O-ring 50 is mounted in a recess 51 to provide a cap-rod fluid seal. Fluid wiped from the rod 17 by the O-ring 50 which would otherwise be trapped between the cap 23 and the ram rod 17 accumulates in a collector chamber 53. Fluid which may bleed past the packing 40 during normal jack operation also collects in this chamber 53. The accumulated fluid flows down a return passage 54 back to the hydraulic fluid reservoir 14.

Figure 2:
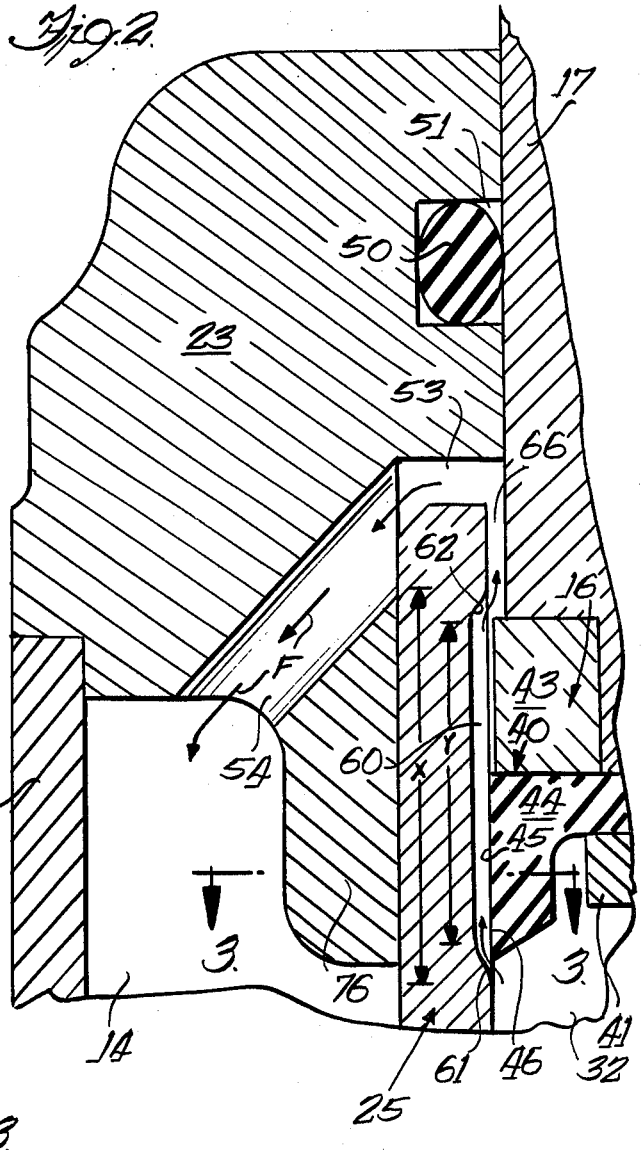
FIG. 2 is a fragmentary section view similar to FIG. 1 showing in yet further detail the pressure relief device shown in FIG. 1.

Relief of the fluid pressure generated within the chamber 32 occurs as the upwardly moving ram head end 16 approaches the cap 23. This relief avoids forcing the ram head end 16 and the ram end packing 40 against the cylinder cap 23, and consequently damaging the cap or the packing, or both. In accordance with the invention, this pressure relief is accomplished without scoring the packing cup 44 and its outer surfaces 46. To this end, an open sided trough 60 is formed in the interior surface 33 of the cylinder 13 at the cylinder top end 25. This trough 60 permits fluid in the chamber 32 to flow past the packing 40 when the the ram head 16 is located substantially adjacent the one cylinder end 25 and the cap 23 as shown in FIG. 2. To provide complete pressure relief, the trough 60 extends over a predetermined length X, which length X is greater than the axial thickness Y of the packing 40. Thus, as the packing 40 reaches the position shown in FIG. 2, fluid flows from a trough bottom end 61, along the trough 60, through a trough top end 62, into the collector chamber 53, and down the return passage 54 into the fluid reservoir 14 as indicated by the arrows F in FIG. 2. It will be noted that a small annular relief area 66 at the cylinder top edge permits the flow of fluid from the trough top end 62 to the collector chamber 53. Excessive jack extending motion is positively inhibited by forming the cross-sectional area of this trough 60 to be substantially equal to or larger than the cross-sectional area of the passage in the base (not shown) along which fluid flows from the hydraulic pump 28 to the chamber 32. Thus, fluid cannot be pumped into the chamber 32 faster than fluid can escape. As can be invisioned from FIG. 2, yet further extension of the ram 15 and its head end 16 toward the cup 23 simply opens progressively greater portions of the trough 60 to fluid relief flow.

Figure 3:
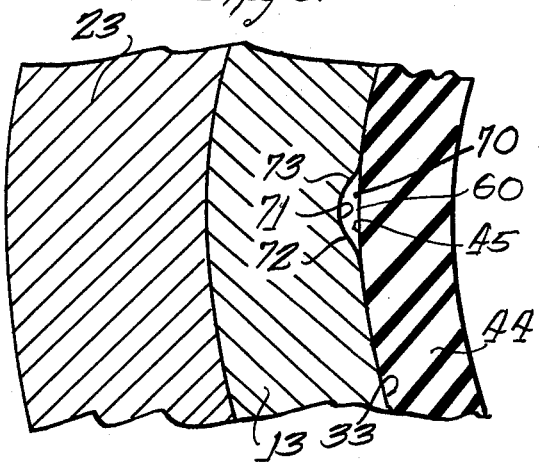
FIG. 3 is a fragmentary sectional view taken substantially in the plane of line 3—3 in FIG. 2.

As explained above, it is a feature of the invention that this release device inhibits damage such as cutting or scoring the outer cup surfaces 46. To this end, the trough includes an open exterior side 70, a rounded interior side 71, and two mediate sides 72 and 73, which mediate sides curve smoothly and gradually from the cylinder interior surface 33, as shown particularly in FIG. 3. The radii of curvature for forming the mediate walls 72 and 73 can be large, as shown, to minimize manufacturing costs and to provide the gradual, smooth surface which prevents cup surface cutting and scoring. Here, the radii of curvature for these walls is of the same order of magnitude as the radius of curvature used to describe the general cross-sectional shape of the trough interior surface 72. The trough ends 61 and 62 are also preferably gradually curved as illustrated in FIG. 2 to prevent cutting the packing material surface 46 moving past the trough ends.

When the jack is provided with the novel trough 60, the sealing cup member 44 can be formed of NEOPRENE brand runber material available from the E. I. DuPont DeNemours & Co., of Wilmington, Delaware. Other elastomeric compositions which can be molded or otherwise formed easily can be used. Preferably the material stock is selected to provide a finished cup member having a stiffness sufficient to prevent the cup member 44 from bowing into the trough 60 when the cup 44 is located adjacent the trough 60 as shown in FIG. 2. Such bowing might lead to trough blockage and consequent fluid flow obstructions. Typically, manufacture of the cup member 44 involves placing a quantity of uncured, thermosetting elastomeric composition in a heated mold, heating the stock material, and applying pressure to the stock material to cause the material to flow into the mold cavities. Upon further heating, the material vulcanizes. Subsequent finishing or fabricating operations may be required, depending upon the precise method of manufacturing.

In carrying out the invention, it has been found that the trough 60, as defined by its smoothly curved sides and ends, can be economically manufactured by cold-forming operations performed upon the interior cylinder surface 33. Coining operations can be employed to form this trough structure economically and effectively.

It is another feature of the invention that this pressure-relieving trough 60 is supported by structure in addition to the cylinder end 75 in which the trough is formed. To this end, the cap 23 includes an axial portion 76 which extends from the collecting chamber 53 over that portion of the cylinder in which the trough 60 is disposed, as illustrated in FIG. 2.

I claim:

1. In a hydraulic jack comprising a cylinder having two ends and an interior surface, a ram having a head portion reciprocable in the cylinder between the cylinder ends and a rod portion partially extending through one cylinder end to exert a jacking action as the ram head portion moves toward that cylinder end, sealing means carried on the ram head portion to provide a substantially fluid-tight seal between the ram and the cylinder interior surface, the improvement comprising opensided trough means in the interior surface of the cylinder to permit the flow of fluid past the sealing means when the head portion is located substantially adjacent the one cylinder end so as to prevent forcing the ram head and sealing means against the cylinder end and a cylinder cap affixed at said one cylinder end extending from that cylinder end axially along said cylinder over that portion of the cylinder in which said trough means is disposed so as to strengthen that portion of the cylinder.

2. The improvement of claim 1 wherein said sealing means is of a predetermined axial thickness, and wherein said trough means extends axially along the cylinder interior over a distance greater than the sealing means axial thickness.

3. An improvement according to claim 1 wherein the jack further comprises a fluid reservoir, a fluid collector chamber at the said one cylinder end, and a fluid return passage for returning fluid from the collector chamber to the reservoir, the improvement further comprising means for passing fluid from the trough means to the collector chamber.

4. An improvement according to claim 1 wherein said trough means includes an open exterior side, an interior side recessed in the cylinder interior surface, and two mediate sides curving smoothly and gradually from the cylinder interior surface to the trough interior side to prevent the cutting of said sealing means when said sealing means moves past the trough means.

5. An improvement according to claim 1 wherein said trough means includes two axially spaced ends defined by trough end surfaces curving smoothly and gradually from the interior surface to the trough means interior side to prevent the cutting of said sealing means when said sealing means moves past the trough means.

6. An improvement according to claim 1 including the further improvement wherein said sealing means includes a packing cup member formed of elastomeric material.

7. The hydraulic jack according to claim 1 wherein said hydraulic jack includes passage means having a predetermined cross-sectional area for introducing fluid into a chamber defined between the ram head end, the cylinder interior surface, and the opposite cylinder end, and wherein said trough means is provided with a cross-sectional area substantially equal to or larger than the passage means to prevent the creation of excessive pressure increase in the chamber.

8. An improvement according to claim 1 wherein said open-sided trough means is located immediately adjacent said sealing means to open progressively more of said trough to fluid flow as the sealing means moves progressively towards said one cylinder end.

9. A hydraulic jack comprising a cylinder having two ends and an interior surface, a ram having a head portion reciprocable in the cylinder between the cylinder ends, sealing means carried on the ram head portion to provide a substantially fluid-tight seal between the ram head portion and the cylinder interior surface, and open-sided trough means cold formed in the interior surface of the cylinder to permit the flow of fluid past the sealing means when the ram head portion is located substantially adjacent the trough means so as to prevent forcing the ram head portion and sealing means against one cylinder end and a cylinder cap affixed at said one cylinder end and extending from that cylinder end axially along said cylinder over that portion of the cylinder in which said trough means is disposed so as to strengthen that portion of the cylinder.

10. A hydraulic cylinder according to claim 9 wherein said open-sided trough means is coined in the interior surface of the cylinder.

11. A hydraulic jack according to claim 9 wherein said sealing means includes an elastomeric cup member.

12. A hydraulic cylinder according to claim 11 wherein said elastomeric cup member includes outer sealing surfaces of predetermined axial length, and wherein said trough means extends axially along the cylinder interior surface over a distance greater than the predetermined axial length of the elastomeric cup member sealing surfaces.

13. A hydraulic jack according to claim 12 wherein said elastomeric cup member is formed of a material having a stiffness sufficient to prevent said cup material from bowing into said trough means when said cup is located adjacent said trough means.

* * * * *

UNITED STATES PATENT AND TRADEMARK OFFICE

CERTIFICATE OF CORRECTION

PATENT NO. : 4,077,608

DATED : March 7, 1978

INVENTOR(S) : R. Harlan Nehrig

It is certified that error appears in the above-identified patent and that said Letters Patent are hereby corrected as shown below:

Column 3, line 53, "runber" should be --rubber--;

Column 4, line 67, after "introducing" insert --hydraulic--

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*